US008490241B2

(12) United States Patent
Ricklefsen et al.

(10) Patent No.: US 8,490,241 B2
(45) Date of Patent: Jul. 23, 2013

(54) ADAPTER DEVICE FOR A PORTABLE CLEANING APPLIANCE AND CLEANING APPARATUS WITH AN ADAPTER DEVICE AND A CLEANING APPLIANCE

(75) Inventors: Dirk Ricklefsen, Aichwald/Aichelberg (DE); Stefan Hess, Leutenbach (DE); Maic Hensel, Backnang (DE)

(73) Assignee: Alfred Kaercher GmbH & Co. KG, Winnenden (DE)

( * ) Notice: Subject to any disclaimer, the term of this patent is extended or adjusted under 35 U.S.C. 154(b) by 0 days.

(21) Appl. No.: 13/343,051

(22) Filed: Jan. 4, 2012

(65) Prior Publication Data

US 2012/0180250 A1 Jul. 19, 2012

Related U.S. Application Data

(63) Continuation of application No. PCT/EP2009/059320, filed on Jul. 20, 2009.

(51) Int. Cl.
*A47L 5/00* (2006.01)

(52) U.S. Cl.
USPC ..... 15/323; 15/327.2

(58) Field of Classification Search
USPC ..... 15/301, 323, 327.2
IPC ..... A47L 5/00
See application file for complete search history.

(56) References Cited

U.S. PATENT DOCUMENTS

| | | | |
|---|---|---|---|
| 2,534,122 | A | 12/1950 | Hamala |
| 5,095,579 | A | 3/1992 | Becker |
| 5,238,142 | A | 8/1993 | Hanna et al. |
| 7,263,742 | B2 | 9/2007 | Valentini |
| 2004/0103494 | A1 | 6/2004 | Valentini |

FOREIGN PATENT DOCUMENTS

| | | |
|---|---|---|
| DE | 1 948 941 | 5/1970 |
| DE | 197 50 543 | 5/1999 |
| DE | 202 09 246 | 8/2002 |
| EP | 0 916 302 | 5/1999 |
| EP | 1 269 903 | 1/2003 |
| EP | 1 424 170 | 6/2004 |
| FR | 1539512 | 9/1968 |
| GB | 773745 | 5/1957 |
| GB | 2 413 265 | 10/2005 |

*Primary Examiner* — David Redding
(74) *Attorney, Agent, or Firm* — Lipsitz & McAllister, LLC

(57) ABSTRACT

The invention relates to an adapter device for arranging a container on the housing of a portable cleaning appliance. The adapter device comprises an adapter plate which is adapted to be fitted on the cover surface of the housing and has on its top side a placement surface for placement of the container, and a locking device for releasably locking the adapter plate to the housing of the cleaning appliance without a tool. The invention also relates to a cleaning apparatus with a cleaning appliance and such an adapter device.

29 Claims, 10 Drawing Sheets

ADAPTER DEVICE FOR A PORTABLE CLEANING APPLIANCE AND CLEANING APPARATUS WITH AN ADAPTER DEVICE AND A CLEANING APPLIANCE

This application is a continuation of international application number PCT/EP2009/059320 filed on Jul. 20, 2009.

The present disclosure relates to the subject matter disclosed in international application number PCT/EP2009/059320 of Jul. 20, 2009, which is incorporated herein by reference in its entirety and for all purposes.

BACKGROUND OF THE INVENTION

The invention relates to an adapter device for arranging a container on the housing of a portable cleaning appliance.

The invention also relates to a cleaning apparatus with a portable cleaning appliance, which comprises a housing, and with an adapter device of the aforementioned kind.

Portable cleaning appliances are used, for example, in the form of portable vacuum cleaners or portable high-pressure cleaners. They are used on construction sites, for example, but also at other operational sites. The cleaning appliances can be carried by the user. The cleaning appliances are often also mobile and have suitable wheels for this purpose.

In many cases, the cleaning appliances are placed in a transport vehicle for transportation to an operational site, and as the stowage space in the transport vehicle is limited in most cases, containers, for example, tool boxes or other containers accommodating utensils are placed on the cleaning appliances during transportation. When the transport vehicle reaches its destination, the containers as well as the cleaning appliance are taken out of the transport vehicle and then carried to the actual operational site.

A cleaning appliance in the form of a vacuum cleaner, the housing of which forms on its top side a cover surface with a recess in which a container can be installed, is known from EP 0 916 302 B1. The container is thereby secured on the cover surface of the housing against slipping. The container can be additionally locked by means of locking elements in the recess of the cover surface. This has the advantage that the vacuum cleaner can be moved together with the container in the form of a single transportation unit by the user. It is, however, necessary for the container to have exactly the dimensions of the recess on the cover surface of the vacuum cleaner. Container and vacuum cleaner must therefore be exactly adapted to each other in their dimensions.

The object of the present invention is to provide a device by means of which a container can be arranged on the housing of a portable cleaning appliance for joint transportation of the cleaning appliance together with the container.

SUMMARY OF THE INVENTION

This object is accomplished, in accordance with the invention, by an adapter device having the features of patent claim 1. The adapter device in accordance with the invention comprises an adapter plate which can be fitted on the housing of the cleaning appliance. Furthermore, the adapter device comprises a locking device by means of which the adapter plate can be releasably locked to the housing of the cleaning appliance without a tool. The adapter plate has on its top side a placement surface for placement of the container.

The invention incorporates the idea that by providing an adapter plate which, on the one hand, is adapted, namely on its underside, to the housing of a portable cleaning appliance, and, which, on the other hand, comprises, namely on its top side, a flat placement surface for a container to be transported together with the cleaning appliance, a compact transportation unit consisting of the container, the adapter plate and the cleaning appliance can be formed in a simple way for joint transportation. The adapter plate can be fitted on the housing of the cleaning appliance and can be subsequently locked by the locking device to the housing of the cleaning appliance without a tool. The locking device interacts with the housing of the cleaning appliance. The container, for example, a box for tools or accessories, can be placed on the top side of the adapter plate. When required, the container can be taken off the adapter plate, and, in addition, the adapter plate can be released from the cleaning appliance. The adapter plate is locked to and unlocked from the housing of the cleaning appliance without the use of any special tool; in particular, it is not necessary, for example, to screw the adapter plate to the cleaning appliance.

The adapter device therefore increases the possibilities of use of the cleaning appliance by it being possible for a container, preferably a box for tools or accessories, to be placed on the cleaning appliance and transported jointly with it.

It is preferable for the adapter plate to be releasably lockable to a housing part, engageable from behind, of the housing of the cleaning appliance by the locking device without a tool. A housing lug, a housing projection engageable from behind or the like may, for example, be used as housing part that is engageable from behind. As a result, additional locking elements can be dispensed with on the cleaning appliance.

It is of particular advantage if the adapter plate is releasably lockable to a carrying handle of the cleaning appliance by the locking device without a tool. The carrying handle is preferably arranged on a top side of the housing of the cleaning appliance. The carrying handle is usually of very stable construction and adapted to the weight of the cleaning appliance, so that the locking of the adapter plate to the carrying handle can be configured so as to have a high mechanical load capacity.

It is advantageous for the locking device to comprise at least one locking member, which is held on the adapter plate so as to be movable back and forth between a lock position and a release position. In the lock position of the least one locking member, the adapter plate is immovably fixed to the housing of the cleaning appliance. To this end, the at least one locking member can, for example, engage from behind or around a housing part, in particular, a carrying handle, which is arranged on the top side of the cleaning appliance and is engageable from behind. If the adapter plate is to be released from the cleaning appliance, to do so, the at least one locking member can be transferred without the use of a tool to its release position in which it releases the housing.

It is particularly advantageous if the locking device comprises a locking grip adapted to be gripped by the user, which is connected to the at least one locking member. By means of the locking grip, the user can move the at least one locking member in a simple way back and forth between its lock position and its release position without using an additional tool.

In an advantageous embodiment, the locking grip protrudes from the placement surface of the adapter plate when the at least one locking member is in the release position and the locking grip does not protrude from the placement surface of the adapter plate when the at least one locking member is in the lock position. In such a configuration, the placement surface is at most obstructed by the locking grip when the locking grip assumes a position in which the at least one locking member assumes its release position. In this position, the adapter plate can be taken off the cleaning appliance. If, however, the at least one locking member is in its lock position, the locking grip is then arranged such that it does not protrude from the placement surface and therefore does not obstruct the placement of a container on the placement surface.

It may, for example, be provided that the locking grip is plate-shaped, and when the at least one locking member is in the lock position, it extends in the plane of the placement surface or below the plane of the placement surface.

To enable the locking grip to be easily gripped by the user, it is of advantage if the locking grip can be gripped from behind.

In an advantageous embodiment of the invention, the at least one locking member is pivotable about a pivot axis. It can thus be pivoted back and forth between its lock position and its release position. The pivot axis is preferably alignable parallel to a longitudinal axis of a carrying handle arranged on the top side of the housing of the cleaning appliance.

It is advantageous for the locking device to comprise two locking members which are rigidly connected to each other and are arranged in spaced relation to each other. This increases the mechanical load capacity of the locking device and the adapter plate locked to the carrying handle.

The locking grip preferably connects the two locking members rigidly to each other.

The at least one locking member is advantageously hook-shaped or bracket-shaped and, in the lock position, engages from below a housing part of the cleaning appliance, for example, a carrying handle.

In a preferred embodiment, the adapter plate comprises on its top side a first recess which receives the locking grip. When the at least one locking member is in the lock position, the locking grip can sink into the first recess of the adapter plate completely, so that the placement surface of the adapter plate is not obstructed by the locking grip.

It is particularly advantageous if the locking grip covers the first recess at least partially and enlarges the placement surface of the adapter plate when the at least one locking member is in the lock position.

As explained above, the adapter device is provided for portable cleaning appliances. In order that the cleaning appliance can also be carried when the adapter plate is locked to the housing of the cleaning appliance, it is provided in an advantageous embodiment of the invention that the adapter device comprises a carrying device with at least one carrying handle which is adapted to be grasped by the user. When the adapter plate is locked to the housing of the cleaning appliance, the complete cleaning apparatus consisting of the cleaning appliance and the adapter device can then be carried by means of the carrying handle of the adapter device.

It is advantageous for the carrying handle of the adapter device to be movable back and forth between a carrying position in which it protrudes from the placement surface of the adapter plate and a rest position in which it does not protrude from the placement surface of the adapter plate. For carrying the adapter device together with the cleaning appliance, the carrying handle is therefore easily accessible to the user in the area of the placement surface from which it protrudes in its carrying position. If, however, a container is to be placed on the placement surface, the carrying handle of the adapter device can be transferred to a rest position in which it does not protrude from the placement surface and, consequently, does not affect the size of the placement surface either.

The carrying handle of the adapter device is preferably pivotable about a pivot axis. This facilitates transfer of the carrying handle of the adapter device from its rest position to its carrying position and back into the rest position. The carrying handle of the adapter device is easily accessible to the user in each position. The pivot axis is preferably alignable parallel to a longitudinal axis of a carrying handle arranged on the top side of the housing of the cleaning appliance.

It may be provided that the adapter plate comprises on its top side a second recess which receives the carrying handle. In its rest position, the carrying handle of the adapter device can sink into the second recess of the adapter plate completely. When required, the user can take the carrying handle of the adapter device out of the second recess of the adapter plate and transfer it to its carrying position in which it protrudes from the placement surface.

It is of advantage if the carrying handle of the adapter device, in its rest position, fills out at least areas of the second recess and enlarges the placement surface of the adapter plate.

It is advantageous for the carrying device of the adapter device to be pivotably mounted on the adapter plate.

It is of advantage if the locking device is held on the carrying device of the adapter device. This facilitates handling of the adapter device both for locking it to the housing of the cleaning appliance and for carrying it together with the cleaning appliance. The mounting of the locking device on the carrying device also makes it possible to assemble the locking device on the carrying device in a first assembly step, and the structural unit consisting of the locking device and the carrying device can then be assembled on the adapter plate in a second assembly step. The assembly costs can thereby be kept low.

It may be provided that the locking device and the carrying device are rigidly connected to each other and held so as to be movable on the adapter plate. In this case, it may be provided that the structural unit consisting of the locking device and the carrying device can be moved back and forth between a first position in which the at least one locking member engages a housing part of the cleaning appliance from behind and the carrying handle of the adapter device assumes its rest position, via a second position in which the at least one locking member also engages the housing part of the cleaning appliance from behind, but the carrying handle of the adapter device assumes its carrying position, and a third position in which the at least one locking member releases the housing part of the cleaning appliance and the carrying handle of the adapter device assumes an inoperative position. Depending on the position of the structural unit consisting of the locking device and the carrying device, the adapter plate can be locked to or unlocked from the housing part of the cleaning appliance, and the carrying handle of the adapter device can assume its rest position or its carrying position.

In a preferred embodiment of the invention, the locking device is movably mounted on the carrying device. This makes it possible to move the locking device relative to the carrying device. In particular, in such an embodiment, the at least one locking member can be moved back and forth between its lock position and its release position without the carrying device having to change its position relative to the adapter device. Conversely, the carrying handle can change its position relative to the adapter device without the position of the locking device having to be changed. As a result, the carrying handle can be moved back and forth between its rest position and its carrying position without the locking of the adapter plate to the housing of the cleaning appliance being influenced by this.

In an advantageous embodiment, it is provided that the locking device is pivotably mounted on the carrying device.

It is advantageous for the locking device and the carrying device to be held on the adapter plate and to be pivotable independently of each other through at least 90° in each case about a common pivot axis. In this case, the common pivot axis can be alignable parallel to a longitudinal axis of a carrying handle arranged on the top side of the housing of the cleaning appliance.

In an advantageous embodiment, assembly of the adapter device is simplified by the locking device being latchable to the carrying device.

As explained above, a container, for example, a box for tools or accessories can be placed on the placement surface of the adapter plate. Here it is of advantage if the adapter plate comprises at least one stop element which protrudes from the placement surface and against which the container is positionable. The stop element facilitates positioning of the container on the placement surface of the adapter plate.

It is advantageous for at least one stop element to comprise a recess for receiving a projection of the container. The container may, for example, comprise peg-shaped projections which are received by a recess of a stop element of the adapter device.

It is particularly advantageous if the adapter device comprises at least one locking element for locking the container to the placement surface of the adapter plate. It is thereby possible to reliably prevent unintentional release of the container from the placement surface.

The at least one locking element is preferably movably, in particular, pivotably, mounted in a recess on the top side of the adapter plate. To lock the container, it can be moved, in particular, pivoted, out of the associated recess of the adapter plate in order to then interact with a complementary locking element of the container.

As mentioned at the outset, the invention relates not only to an adapter device of the aforementioned kind but also to a cleaning apparatus with such an adapter device and with a portable cleaning appliance.

The cleaning appliance preferably comprises a housing part, for example, a housing lug or a housing projection or the like, which is engageable from behind, and the locking device of the adapter device interacts with the housing part that is engageable from behind to releasably lock the adapter plate to the housing without a tool. Additional locking elements on the cleaning appliance are, consequently, not necessary for locking the adapter plate.

It is of quite particular advantage if the cleaning appliance comprises a carrying handle, and the adapter plate of the adapter device is releasably lockable to the carrying handle by the locking device without a tool.

In an advantageous embodiment of the invention, the carrying handle is arranged on the top side of the housing of the cleaning appliance. In particular, it may be provided that the carrying handle is integrated into a cover surface on the top side of the housing, on which the adapter plate can be fitted.

The cleaning appliance is preferably configured as a vacuum cleaner. It may, however, also be provided that the cleaning appliance takes the form of a high-pressure cleaner.

In a particularly preferred embodiment of the cleaning apparatus in accordance with the invention, the cleaning appliance comprises a mobile base, on which wheels are rotatably mounted, and a cleaning unit with a handle bar arranged on the base, wherein the cleaning unit comprises the housing to which the adapter plate is lockable, and wherein the handle bar, in an upright position, is aligned substantially perpendicularly to the placement surface of the adapter plate locked to the housing. In such an embodiment, the cleaning appliance can be moved by means of the base, and after the adapter plate is locked to the housing of the cleaning appliance, a container can be placed on the placement surface of the adapter plate, and the container can then also be supported at the upright handle bar. In its upright position, the handle bar is aligned substantially perpendicularly to the placement surface of the adapter plate. The container can therefore protrude beyond the adapter plate and be supported in its protruding area at the handle bar.

It is of particular advantage if the cleaning appliance is pivotable together with at least one container arranged on the placement surface of the adapter plate about a common axis of rotation of two wheels. The cleaning appliance can then be moved together with the adapter device locked to the cleaning appliance and the at least one container in the manner of a sack truck. The container is reliably positionable on the cleaning appliance by means of the adapter device; it is preferably lockable to the adapter plate. It is of particular advantage if the container comprises a carrying handle on its top side, so that the user can carry the container together with the adapter device and the cleaning appliance after locking of the adapter plate to the housing of the cleaning appliance in a first step and subsequent locking of the container to the adapter plate. The user can then choose whether he pivots the complete cleaning apparatus together with the container arranged on the top side about the common axis of rotation of two wheels of the cleaning appliance and moves the cleaning appliance with the container in the manner of a sack truck, or whether he, for example, in order to climb a step, lifts the container together with the cleaning appliance and the adapter device arranged between these by the carrying handle of the container.

The following description of a preferred embodiment of the invention serves, in conjunction with the drawings, to explain the invention in greater detail.

DETAILED DESCRIPTION OF THE INVENTION

Figure 1:
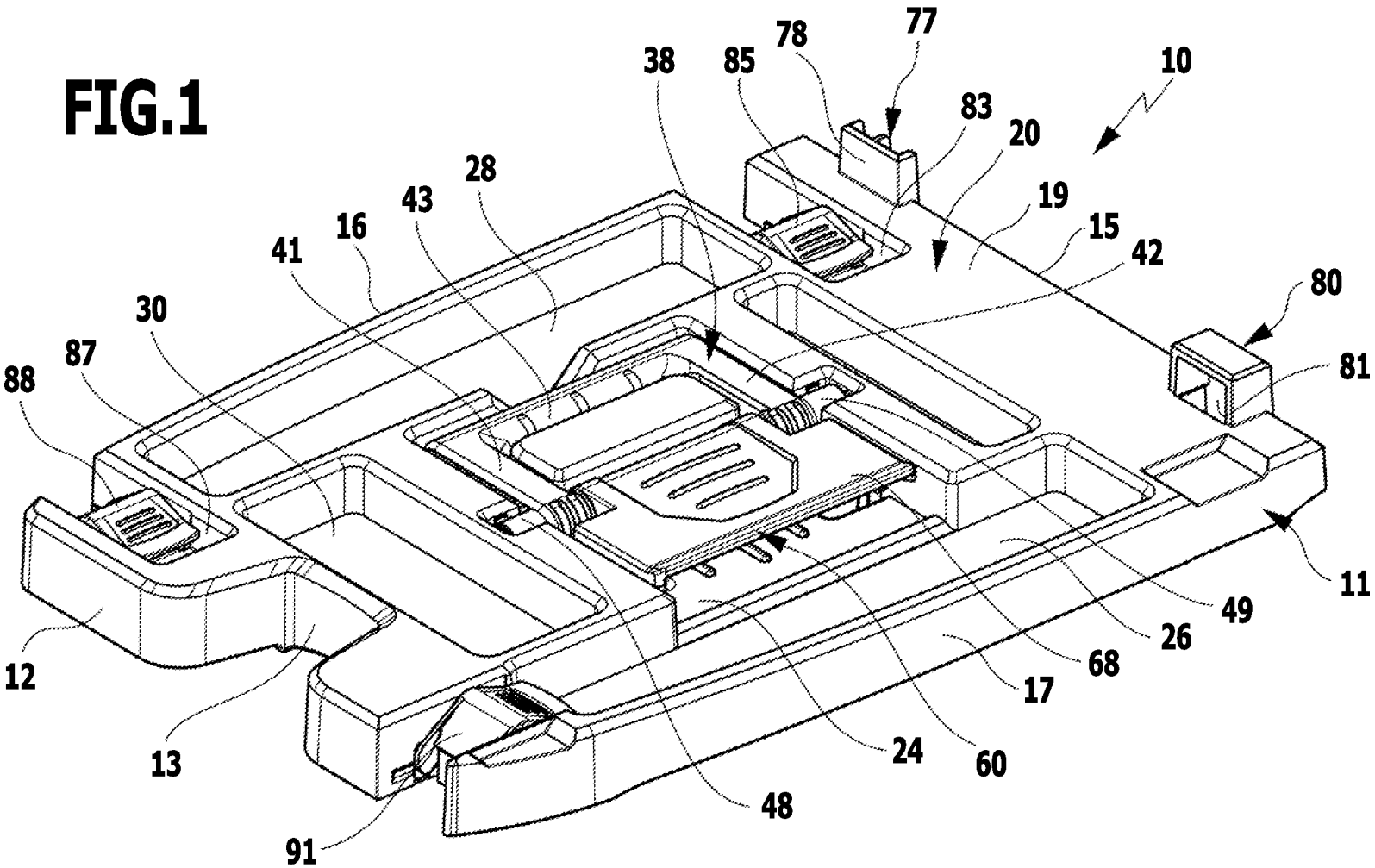
FIG. 1 shows a perspective representation of an adapter device in accordance with the invention.
Figure 2:
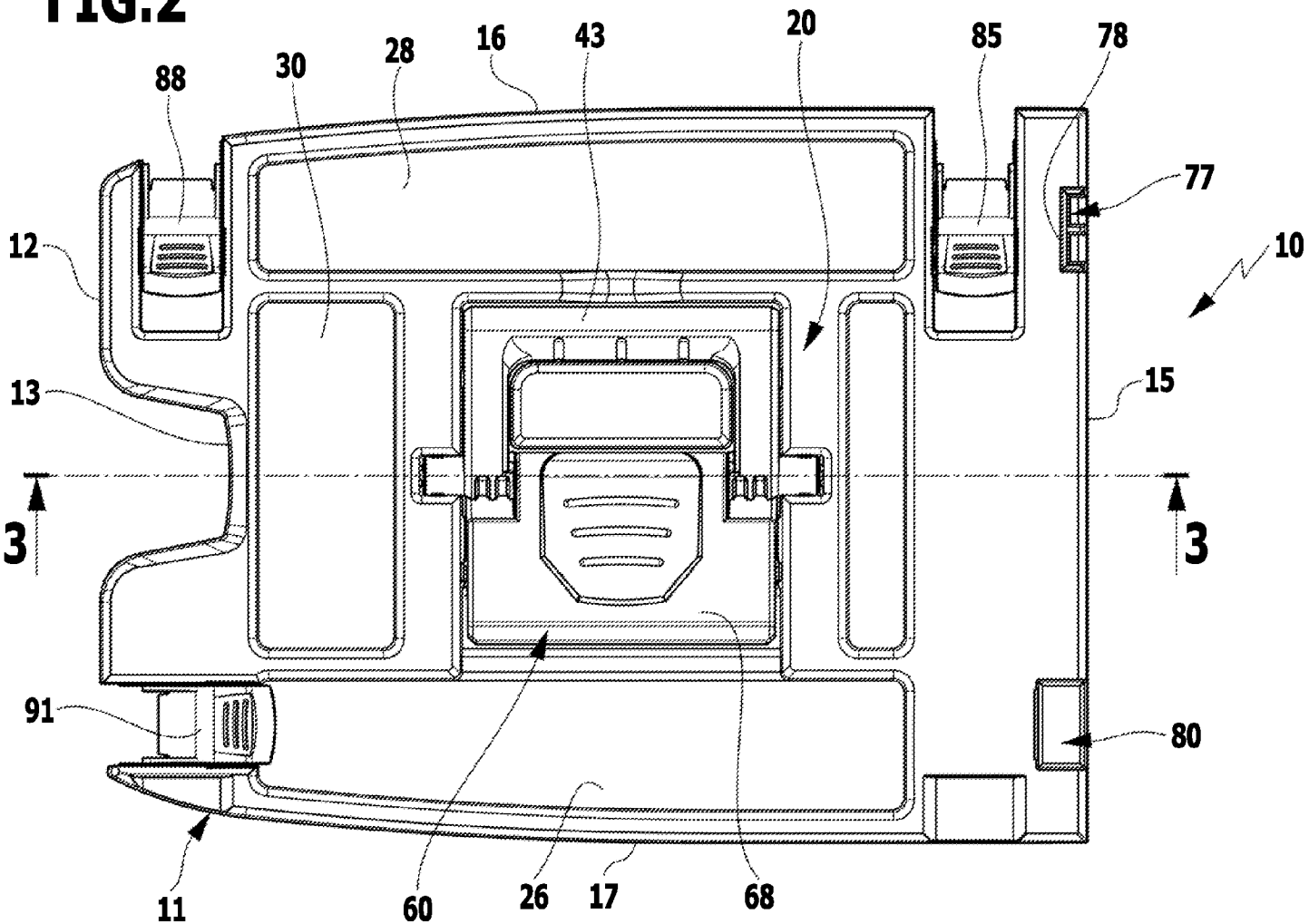
FIG. 2 shows a plan view of the adapter device from FIG. 1.
Figure 3:
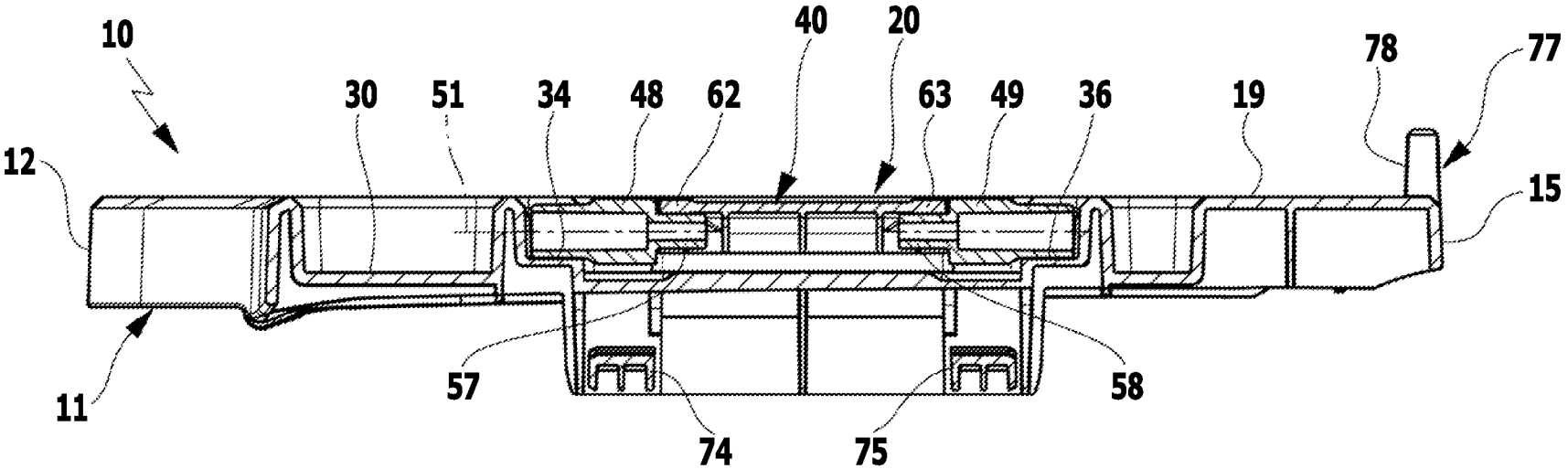
FIG. 3 shows a sectional view of the adapter device taken along line 3-3 in FIG. 2.
Figure 4:
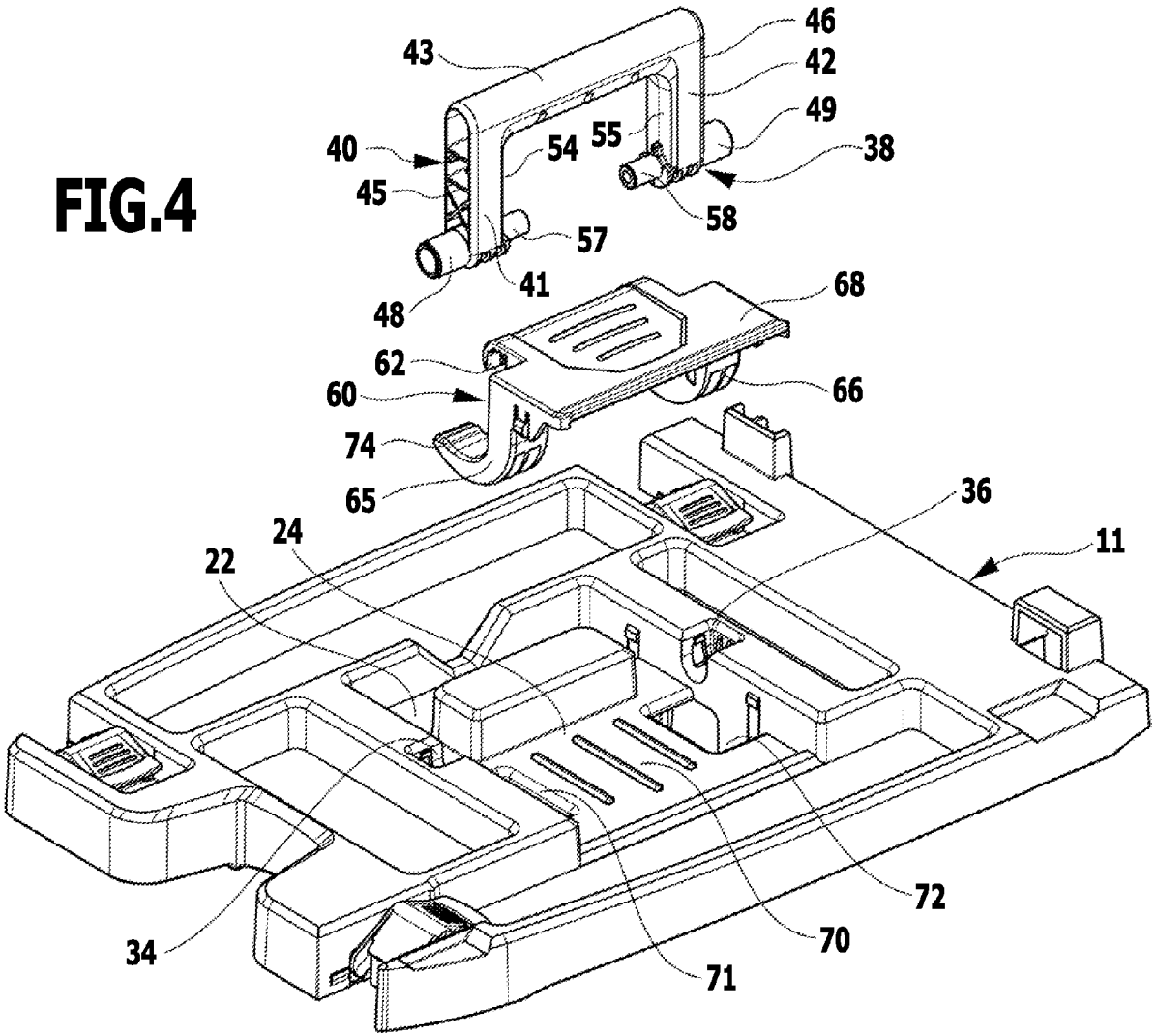
FIG. 4 shows a representation of the adapter device in the manner of an exploded drawing.
Figure 5:
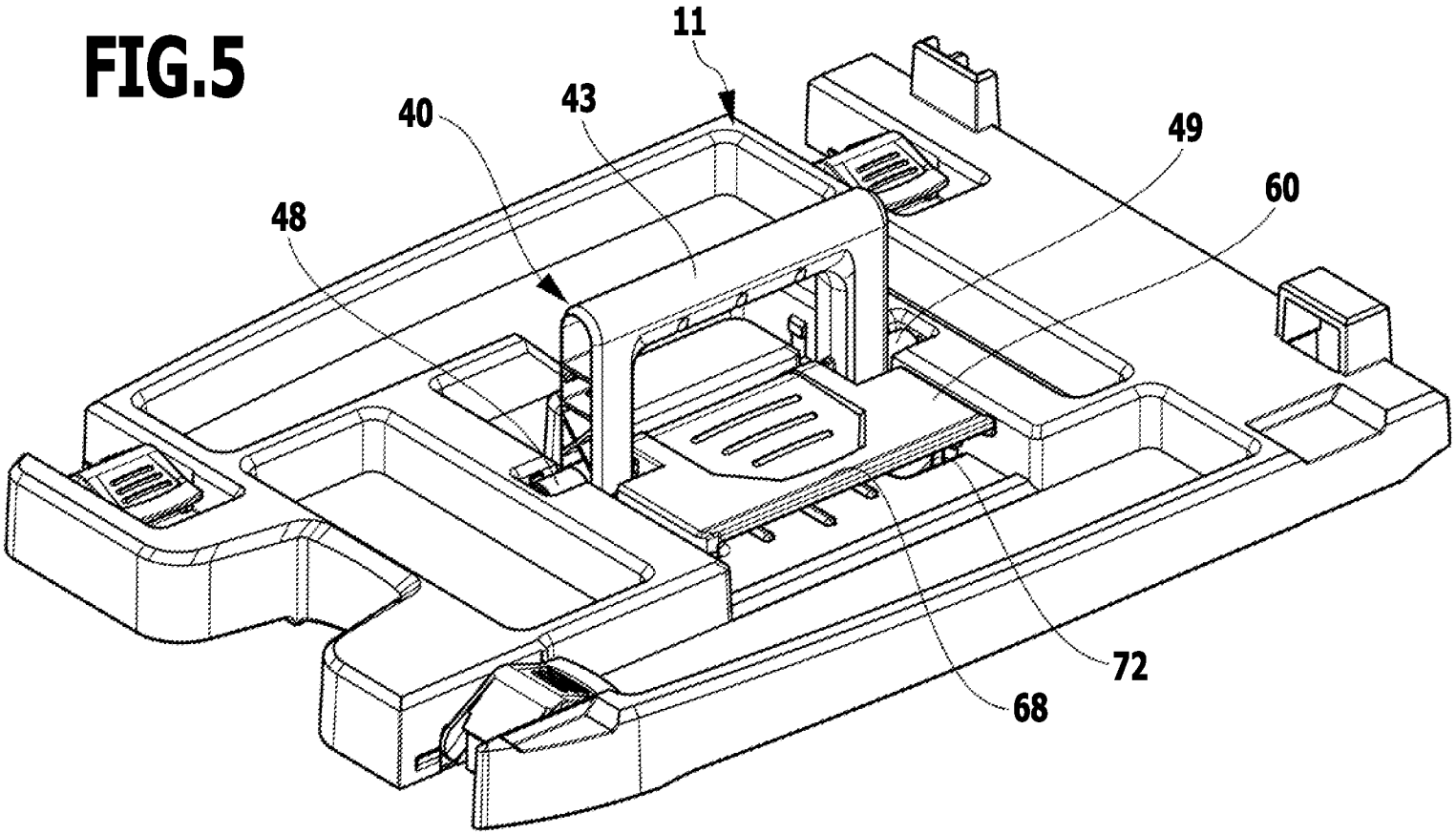
FIG. 5 shows a perspective representation of the adapter device, wherein a carrying handle assumes its carrying position and a locking device its lock position.
Figure 6:
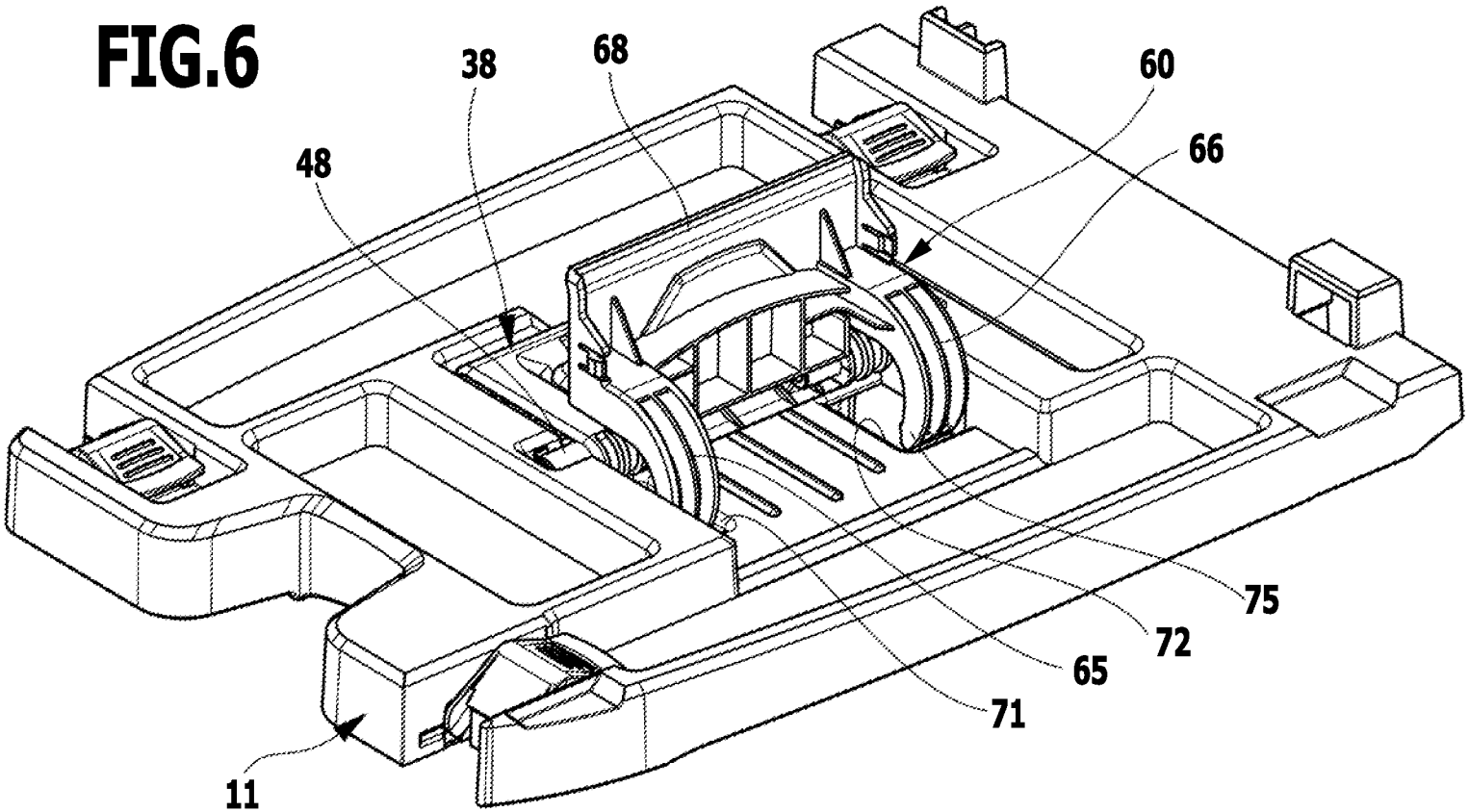
FIG. 6 shows a perspective representation of the adapter device, wherein the carrying handle assumes its rest position and the locking device its release position.
Figure 7:
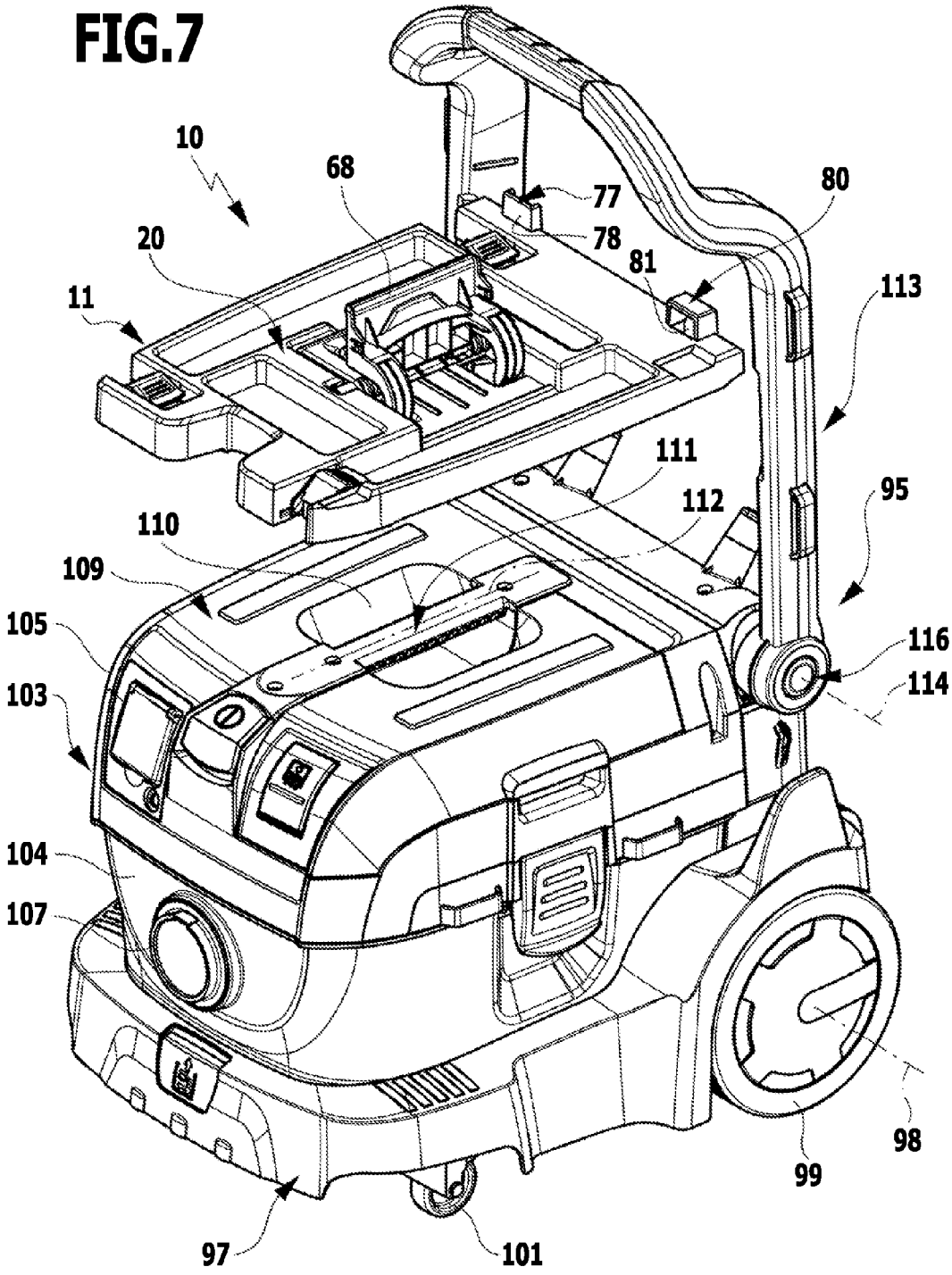
FIG. 7 shows a perspective representation of a cleaning apparatus in accordance with the invention in the manner of an exploded drawing with a cleaning appliance and an adapter device, wherein a locking device of the adapter device assumes its release position.
Figure 8:
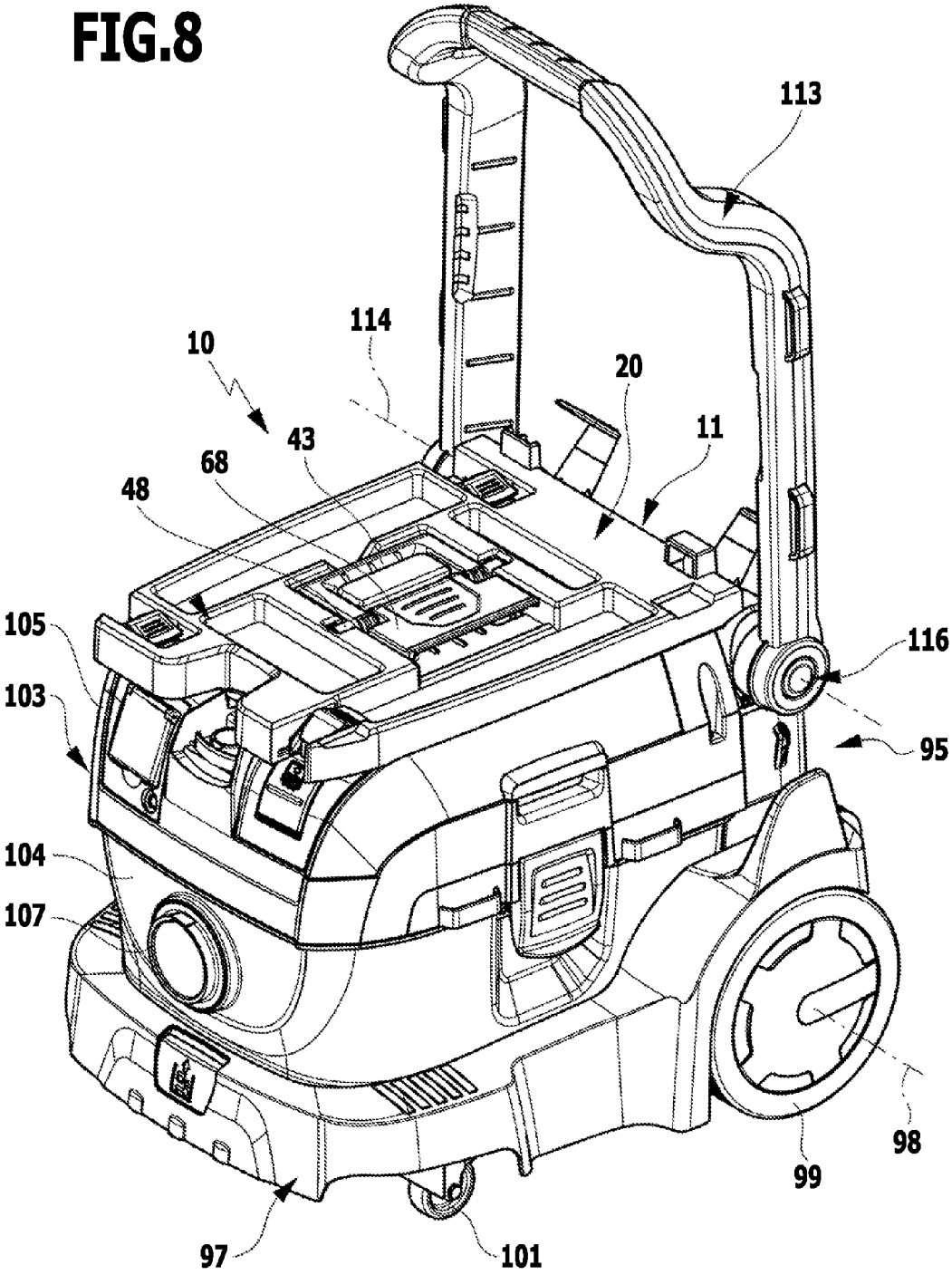
FIG. 8 shows a perspective representation of the cleaning apparatus, wherein the adapter device is locked to the cleaning appliance.
Figure 9:
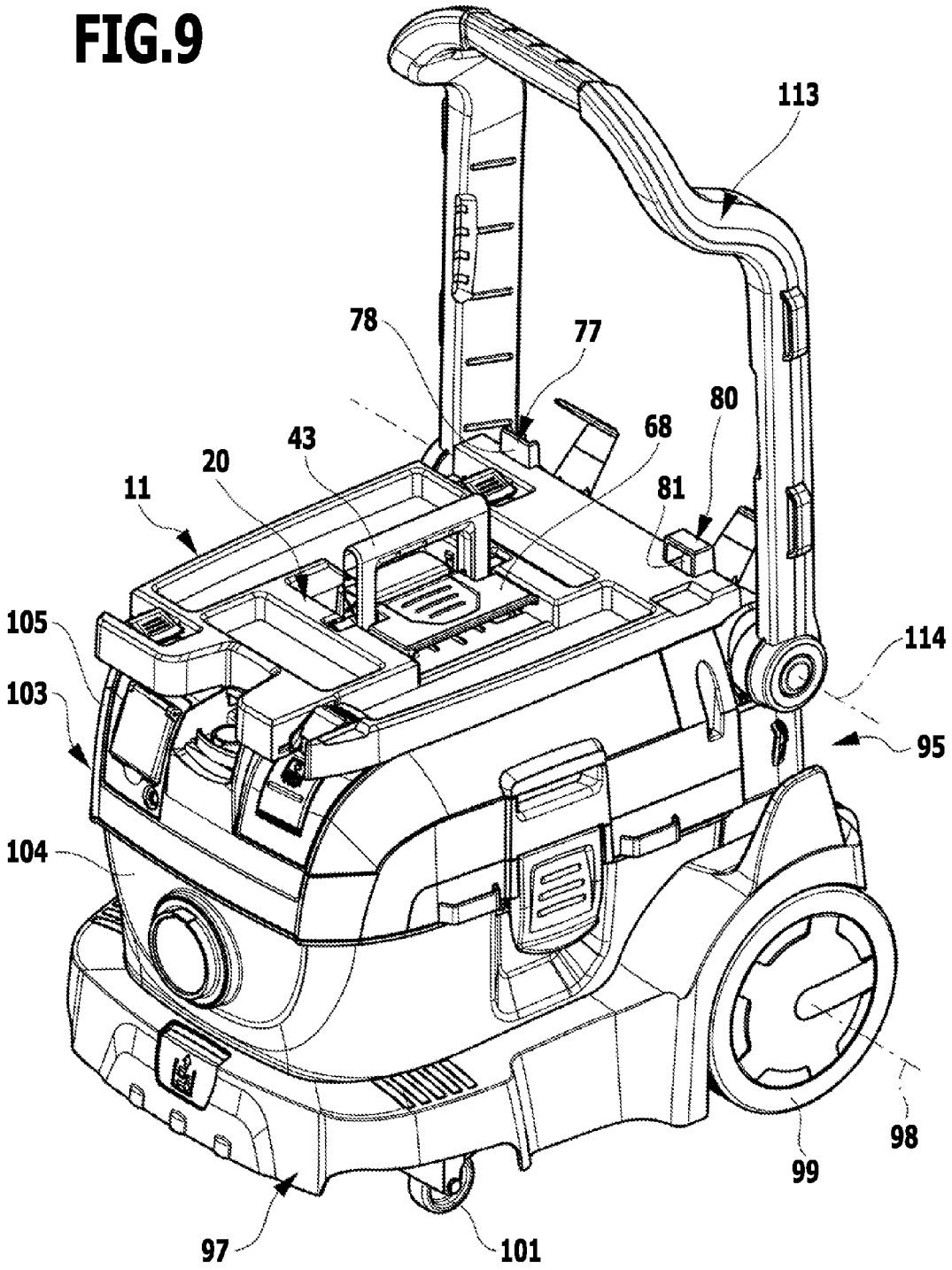
FIG. 9 shows a perspective representation of the cleaning apparatus, wherein the adapter device is locked to the cleaning appliance and a carrying handle of the adapter device assumes its carrying position.
Figure 10:
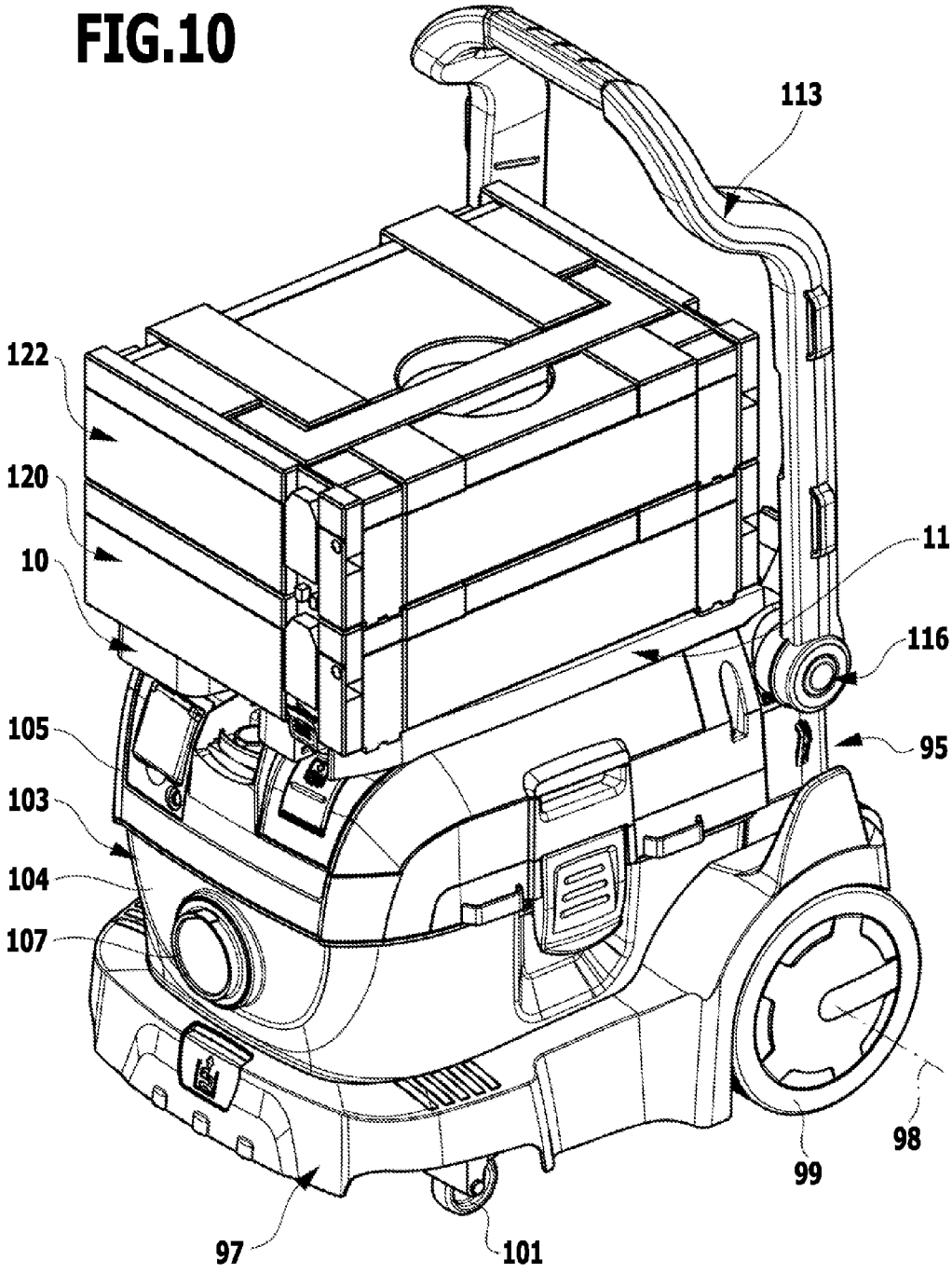
FIG. 10 shows a perspective representation of the cleaning apparatus with two containers placed on it.

FIGS. 1 to 6 show an adapter device 10 in accordance with the invention, which can be placed on the cover surface of a housing of a cleaning appliance shown in FIGS. 7 to 10, and itself forms a placement surface for a container, as shown, for example, in FIG. 10.

The adapter device 10 comprises an adapter plate 11, which, in a plan view, is substantially rectangular, with a central indentation 13 at a front edge 12. A rear edge 15 of the adapter plate 11 is straight-lined, and a first longitudinal edge 16 and also a second longitudinal edge 17 have a slightly convex, outwardly curved shape. The two longitudinal edges 16 and 17 are directed away from each other and each join the rear edge 15 to the front edge 12.

The top side 19 of the adapter plate 11 has a flat placement surface 20 and a central, substantially U-shaped first recess 22 and an adjoining, rectangular second recess 24, which is adjoined, adjacent to the second longitudinal edge 17, by a third rectangular recess 26. Adjacent to the first longitudinal edge 16, the adapter plate 11 has on its top side 19 a fourth rectangular recess 28, and, adjacent to the central indentation 13, a fifth rectangular recess 30 is located between the third and the fourth recesses 26, 28.

A first latching recess 34 and a second latching recess 36 are formed in alignment with each other in the area of transition between the first and second recesses 22, 24 in the top side 19. A carrying device 38 is latched into the two latching recesses 34 and 36. The carrying device 38 comprises a U-shaped carrying bracket 40 with a first carrying leg 41 and a second carrying leg 42, which are integrally connected to each other by a web-like carrying handle 43. On their outer sides 45 and 46, respectively, which are directed away from each other, the two carrying legs 41 and 42 carry at their free end a first joint pin 48 and a second joint pin 49, respectively. The two joint pins are in alignment with each other and can be latched to the first latching recess 34 and the second latching recess 36, respectively. The two joint pins 48 and 49 define a pivot axis 51 which extends perpendicularly to the rear edge 15, and about which the carrying device 38 can be pivoted after the joint pins 48 and 49 have been latched to the latching recesses 34 and 36. This makes it possible to pivot back and forth the carrying bracket 40 and, consequently, also the carrying handle 43 between a rest position in which it sinks completely into the U-shaped first recess 22, and a carrying position in which the carrying bracket 40 is oriented perpendicularly to the placement surface 20 and the carrying handle 43 can be grasped by the user. The carrying bracket 40 and, consequently, also the carrying handle 43 protrude in the carrying position, as represented, for example, in FIG. 5, from the placement surface 20. In the rest position, in contrast, the carrying bracket 40 fills out the first recess 22 completely and therefore enlarges the flat placement surface 20. This will be clear, in particular, from FIG. 1.

On their inner sides 54 and 55, respectively, that face each other, the two carrying legs 41 and 42 carry in alignment with the joint pins 48 and 49 a third joint pin 57 and a fourth joint pin 58, respectively. A locking device 60 of the adapter device 10 is latched to these joint pins. For this purpose, the locking device 60 comprises two latching clamps 62, 63, which can be latched to the third and fourth joint pins 57 and 58, respectively, and the locking device 60 can be pivoted back and forth about the pivot axis 51 relative to the carrying device 38 between a lock position shown in FIG. 5 and a release position shown in FIG. 6.

The locking device 60 comprises a first locking member in the form of a first locking bracket 65 and a second locking member in the form of a second locking bracket 66, which are of identical construction and are connected to each other by a rigid, plate-shaped locking grip 68. Associated with the two locking brackets 65 and 66, in the base 70 of the second recess 24, is a through-opening 71 and 72, respectively, through which the locking brackets 65 and 66, respectively, can pass when the locking device 60 is in the lock position. Therefore, in the lock position, the locking brackets 65 and 66 protrude with their free end sections 74 and 75, respectively, from the underside of the adapter plate 11. This will be clear, in particular, from FIG. 3.

When the locking device 60 is in the lock position, the plate-shaped locking grip 68 covers at least a partial area of the second recess 24 and therefore enlarges, in the lock position, the placement surface 20. The user can grip the locking grip 68 from behind when the locking device 60 is in the lock position. To this end, the user can reach behind the locking grip 68 in the area of transition between the second recess 24 and the third recess 26. He can then pivot the locking grip 68 together with the locking brackets 65 and 66 outwardly about the pivot axis 51 into the release position shown in FIG. 6.

In this position, the free end sections 74 and 75 of the locking brackets 65 and 66 reach the level of the base 70 of the second recess 24, but they no longer protrude from the underside of the adapter plate 11.

In the area of the rear edge 15, the adapter plate 11 carries at its top side 19 a first stop 77 protruding from the placement surface 20 with a first stop surface 78 oriented substantially perpendicularly to the placement surface 20. A second stop 80 protrudes from the placement surface 20 at a distance from the first stop 77 in the area of the rear edge 15. The second stop 80 has a rectangular recess 81 facing the third recess 26.

In the area between the first stop 77 and the fourth recess 28, the adapter plate 11 has at its top side 19 a sixth recess 83, which opens into the first longitudinal edge 16 and in which a first locking element in the form of a first latching bracket 85 is pivotably mounted.

Between the fourth recess 28 and the front edge 12 of the adapter plate 11 there is formed in the top side 19 a seventh recess 87, which is substantially identical in configuration to the sixth recess 83 and opens into the first longitudinal edge 16. A second locking element in the form of a second latching bracket 88 is pivotably mounted in the seventh recess 87. The second latching bracket 88 is identical in configuration to the first latching bracket 85.

Between the third recess 26 and the front edge 12 of the adapter plate 11 there is formed in the top side 19 an eighth recess 90, which is substantially identical in configuration to the sixth and seventh recesses, but it is turned through 90° and opens into the front edge 12. In the eighth recess 90 there is pivotably mounted a third locking element in the form of a third latching bracket 91, which is identical in configuration to the second latching bracket 88 and the first latching bracket 85.

As mentioned above, the adapter device 10 is used for arranging a container on the housing of a portable cleaning appliance. Such a cleaning appliance is represented in the form of a vacuum cleaner 95 in FIGS. 7 to 10. This comprises a base 97 with two rear wheels freely rotatable about a common axis of rotation 98, only a rear wheel 99 of which is represented in the drawings, and with two front wheels, only a front wheel 101 of which is represented in the drawings. The base 97 can be moved along a floor surface by means of the wheels 99, 101.

There is placed on the base 97 a suction unit 103, which comprises a lower housing part 104 and an upper housing part 105. The lower housing part 104 forms in the usual manner a dirt collection container into which suction air can be sucked together with suction material via a suction inlet 107. A suction hose carrying a suction nozzle at its free end can be connected in the usual manner to the suction inlet 107. Such suction hoses and suction nozzles are known per se to the person skilled in the art and are, therefore, not represented in the drawings.

The upper housing part 105 receives in the usual manner a suction turbine which is driven by an electric motor. The dirt collection container of the lower housing part 104 can be subjected to negative pressure by the suction turbine.

On its top side, the upper housing part 104 comprises a cover surface 109 with a central recess 110, which is bridged in the manner of a web by a carrying handle 111. The vacuum cleaner 95 can be carried by the user by means of the carrying handle 111.

A substantially U-shaped handle bar 113 is mounted in a rearward area on the upper housing part 105 for pivotal movement about a pivot axis 114. The handle bar 113 can be pivoted back and forth about the pivot axis 114 between a pivoted-out or upright position shown in FIGS. 7 to 10 and a pivoted-in position not shown in the drawings. The handle bar 113 can be locked in its pivoted-out position by a locking device 116 arranged at the free end of at least one leg of the handle bar 113.

The adapter device 10 can be placed on the cover surface 109 of the vacuum cleaner 95, with the pivot axis 51 of the carrying device 38 and the locking device 60 aligned parallel to a longitudinal axis 112 of the carrying handle 111. The adapter plate 11 can then be locked to the carrying handle 111 of the vacuum cleaner 95 by the locking device 60 being pivoted from its release position shown in FIG. 7 into the lock position shown in FIG. 8. In the lock position, the free end sections 74 and 75 of the locking brackets 65 and 66 engage from behind the carrying handle 111 of the vacuum cleaner 95. The carrying handle 111 thus forms a housing part of the vacuum cleaner 95, which can be engaged from behind and to which the adapter plate 11 can be releasably locked by the locking device 60 without a tool. The adapter plate 11 is thereby held immovably on the cover surface 109. A container 120, as shown in FIG. 10, can then be placed on the placement surface 20 of the adapter plate 11. A further container 122 can be positioned on the container 120. For alignment on the placement surface 20, the container 120 can be positioned in such a way that with a side area it abuts against the first stop surface 78 of the first stop 77 and with a lateral peg-shaped projection engages the recess 81 of the second stop 80. The container 120 can then be locked on the placement surface 20 by the latching brackets 85, 88 and 91. The container 120 then forms jointly with the adapter device 10 and the vacuum cleaner 95 a compact transportation unit, which can be moved along a floor surface by means of the wheels 99 and 101 of the base 97. The transportation unit can also be pivoted backwards about the common axis of rotation 98 and then moved in the manner of a sack truck.

If no container 120 is placed on the placement surface 20 of the adapter plate 11 locked to the carrying handle 111 of the vacuum cleaner 95, the adapter device 10 can be lifted together with the vacuum cleaner 95 by the user. For this purpose, the user can pivot the carrying bracket 40 out of its rest position in which it sinks completely into the first recess 22 into its carrying position in which the carrying bracket and, above all, the carrying handle 43 protrude from the placement surface 20, so that the user can grasp the carrying handle 43 with one hand. This will be clear, in particular, from FIG. 9.

The adapter device 10 thus makes it possible to place a container 120 on the vacuum cleaner 95 although the cover surface 109 of the vacuum cleaner 95 is curved in at least partial areas thereof and also has elevations. For this purpose, the adapter plate 11 defines on its top side 19 a flat placement surface 20 for placement of the container 120, and for easier positioning of the container 120, the placement surface 20 has upwardly protruding stops 77 and 80. The adapter plate 11 can be easily locked to the housing 105 of the vacuum cleaner 95 by the locking device 60, so that the cleaning apparatus formed by the adapter device 10 and the vacuum cleaner 95 can be carried by the user by the carrying handle 43.

The adapter device 10 can be used by the user, as required, and he can secure it to the housing 105 of the vacuum cleaner 95 without using a special tool and also release it again from the housing 105 of the vacuum cleaner 95 without a tool.

The invention claimed is:

1. Adapter device for arranging a container on a housing of a portable cleaning appliance, comprising:

an adapter plate which is adapted to be fitted on said housing and has on a top side a placement surface for placement of said container, and a locking device for releasably locking said adapter plate to said housing of said cleaning appliance;

wherein the adapter plate is releasably lockable to a housing part, engageable from behind, of the housing of the cleaning appliance by the locking device without a tool.

2. Adapter device for arranging a container on a housing of a portable cleaning appliance, comprising:

an adapter plate which is adapted to be fitted on said housing and has on a top side a placement surface for placement of said container, and a locking device for releasably locking said adapter plate to said housing of said cleaning appliance;

wherein the adapter plate is releasably lockable to a carrying handle of the cleaning appliance, which is arranged on a top side of the housing of the cleaning appliance, by the locking device without a tool.

3. Adapter device in accordance with claim 1, wherein the locking device comprises at least one locking member, which is held on the adapter plate so as to be movable back and forth between a lock position and a release position.

4. Adapter device in accordance with claim 3, wherein the locking device comprises a locking grip adapted to be gripped by a user, the locking grip being connected to the at least one locking member.

5. Adapter device in accordance with claim 4, wherein the locking grip protrudes from the placement surface of the adapter plate when the at least one locking member is in the release position and does not protrude from the placement surface of the adapter plate when the at least one locking member is in the lock position.

6. Adapter device in accordance with claim 4, wherein the locking grip is plate-shaped and is arranged in a plane of the placement surface or below the plane of the placement surface when the at least one locking member is in the lock position.

7. Adapter device in accordance with claim 3, wherein the at least one locking member is pivotable about a pivot axis.

8. Adapter device in accordance with claim 3, wherein the locking device comprises two locking members which are rigidly connected to each other and are arranged in spaced relation to each other.

9. Adapter device in accordance with claim 8, wherein a locking grip adapted to be gripped by a user connects the two locking members rigidly to each other.

10. Adapter device for arranging a container on a housing of a portable cleaning appliance, comprising:

an adapter plate which is adapted to be fitted on said housing and has on a top side a placement surface for placement of said container, and a locking device for releasably locking said adapter plate to said housing of said cleaning appliance without a tool;

wherein:

the locking device comprises at least one locking member, which is held on the adapter plate so as to be movable back and forth between a lock position and a release position; and the at least one locking member is hook-shaped or bracket-shaped and, in the lock position, engages the housing part of the cleaning appliance from below.

11. Adapter device in accordance with claim 4, wherein the adapter plate comprises on the top side a first recess which receives the locking grip.

12. Adapter device in accordance with claim 1, wherein the adapter device comprises a carrying device with at least one carrying handle which is adapted to be grasped by a user.

13. Adapter device in accordance with claim 12, wherein the carrying handle is movable back and forth between a carrying position in which the carrying handle protrudes from the placement surface of the adapter plate and a rest position in which the carrying handle does not protrude from the placement surface of the adapter plate.

14. Adapter device in accordance with claim 12, wherein the carrying handle of the adapter device is pivotable about a pivot axis.

15. Adapter device in accordance with claim 13, wherein the adapter plate comprises on the top side a second recess which receives the carrying handle.

16. Adapter device in accordance with claim 12, wherein the carrying device of the adapter device is pivotably mounted on the adapter plate.

17. Adapter device in accordance with claim 12, wherein the locking device is held on the carrying device.

18. Adapter device in accordance with claim 17, wherein the locking device is movably mounted on the carrying device.

19. Adapter device in accordance with claim 1, wherein the adapter plate comprises at least one stop element which protrudes from the placement surface and against which the container is positionable.

20. Adapter device in accordance with claim 19, wherein at least one stop element comprises a recess for receiving a projection of the container.

21. Adapter device in accordance with claim 1, wherein the adapter device comprises at least one locking element for locking the container to the placement surface of the adapter plate.

22. Adapter device in accordance with claim 21, wherein the at least one locking element is movably mounted in a recess on the top side of the adapter plate.

23. Cleaning apparatus, comprising:

a portable cleaning appliance, which comprises a housing, and an adapter device for arranging a container on the housing, the adapter device comprising:

an adapter plate which is adapted to be fitted on said housing and has on a top side a placement surface for placement of said container, and a locking device for releasably locking said adapter plate to said housing of said cleaning appliance;

wherein the adapter plate is releasably lockable to a carrying handle of the cleaning appliance, which is arranged on a top side of the housing of the cleaning appliance, by the locking device without a tool.

24. Cleaning apparatus in accordance with claim 23, wherein the cleaning appliance is configured as a vacuum cleaner.

25. Adapter device for arranging a container on a housing of a portable cleaning appliance, comprising:

an adapter plate which is adapted to be fitted on said housing and has on a top side a placement surface for placement of said container, and a locking device for releasably locking said adapter plate to said housing of said cleaning appliance without a tool;

wherein the adapter plate comprises at least one stop element which protrudes from the placement surface and against which the container is positionable.

26. Adapter device for arranging a container on a housing of a portable cleaning appliance, comprising:

an adapter plate which is adapted to be fitted on said housing and has on a top side a placement surface for placement of said container, and a locking device for releasably locking said adapter plate to said housing of said cleaning appliance without a tool;

wherein the adapter device comprises at least one locking element for locking the container to the placement surface of the adapter plate.

27. Cleaning apparatus, comprising:

a portable cleaning appliance, which comprises a housing, and an adapter device for arranging a container on the housing, the adapter device comprising:

an adapter plate which is adapted to be fitted on said housing and has on a top side a placement surface for placement of said container, and a locking device for releasably locking said adapter plate to said housing of said cleaning appliance;

wherein the adapter plate is releasably lockable to a housing part, engageable from behind, of the housing of the cleaning appliance by the locking device without a tool.

28. Cleaning apparatus, comprising:

a portable cleaning appliance, which comprises a housing, and an adapter device for arranging a container on the housing, the adapter device comprising:

an adapter plate which is adapted to be fitted on said housing and has on a top side a placement surface for placement of said container, and a locking device for releasably locking said adapter plate to said housing of said cleaning appliance without a tool;

wherein the adapter plate comprises at least one stop element which protrudes from the placement surface and against which the container is positionable.

29. Cleaning apparatus, comprising:

a portable cleaning appliance, which comprises a housing, and an adapter device for arranging a container on the housing, the adapter device comprising:

an adapter plate which is adapted to be fitted on said housing and has on a top side a placement surface for placement of said container, and a locking device for releasably locking said adapter plate to said housing of said cleaning appliance without a tool;

wherein the adapter device comprises at least one locking element for locking the container to the placement surface of the adapter plate.

* * * * *